US009210793B2

(12) United States Patent
Nishio et al.

(10) Patent No.: US 9,210,793 B2
(45) Date of Patent: Dec. 8, 2015

(54) CHARGED PARTICLE BEAM RADIATION CONTROL DEVICE AND CHARGED PARTICLE BEAM RADIATION METHOD

(75) Inventors: Teiji Nishio, Kashiwa (JP); Toshiki Tachikawa, Niihama (JP)

(73) Assignees: NATIONAL CANCER CENTER, Tokyo (JP); SUMITOMO HEAVY INDUSTRIES, LTD., Tokyo (JP)

( * ) Notice: Subject to any disclaimer, the term of this patent is extended or adjusted under 35 U.S.C. 154(b) by 899 days.

(21) Appl. No.: 12/883,630

(22) Filed: Sep. 16, 2010

(65) Prior Publication Data

US 2012/0068631 A1 Mar. 22, 2012

(51) Int. Cl.
*H05H 7/00* (2006.01)
*H05H 13/00* (2006.01)

(52) U.S. Cl.
CPC ..... *H05H 7/001* (2013.01); *H05H 13/005* (2013.01); *H05H 2277/11* (2013.01)

(58) Field of Classification Search
CPC ..... H05H 7/00; H05H 2277/10
USPC ..... 315/500, 501, 505
See application file for complete search history.

(56) References Cited

U.S. PATENT DOCUMENTS

| | | | | |
|---|---|---|---|---|
| 5,932,880 | A * | 8/1999 | Koguchi et al. | 250/397 |
| 6,242,747 | B1 * | 6/2001 | Sugitani et al. | 250/396 R |
| 7,432,516 | B2 * | 10/2008 | Peggs et al. | 250/492.3 |
| 2009/0283702 | A1 * | 11/2009 | Umezawa et al. | 250/492.3 |
| 2009/0289194 | A1 * | 11/2009 | Saito | 250/396 R |
| 2010/0134007 | A1 * | 6/2010 | Booker et al. | 315/3 |

FOREIGN PATENT DOCUMENTS

| | | | |
|---|---|---|---|
| JP | H4-174999 | A | 6/1992 |
| JP | H10-28742 | A | 2/1998 |
| JP | 2002-25797 | | 1/2002 |
| JP | 2004-31115 | A | 1/2004 |

* cited by examiner

*Primary Examiner* — Alexander H Taningco
*Assistant Examiner* — David Lotter
(74) *Attorney, Agent, or Firm* — Squire Patton Boggs (US) LLP

(57) ABSTRACT

Provided is a charged particle beam radiation control device that controls radiation of a charged particle beam, the charged particle beam radiation control device including: a controller which controls an acceleration voltage for accelerating charged particles, wherein the controller includes a set acceleration voltage controller which selects a non-radiation state of a charged particle beam by setting an acceleration voltage of a radiation state of the charged particle beam to a reference acceleration voltage and changing the acceleration voltage to a set acceleration voltage larger or smaller than the reference acceleration voltage.

4 Claims, 9 Drawing Sheets

CHARGED PARTICLE BEAM RADIATION CONTROL DEVICE AND CHARGED PARTICLE BEAM RADIATION METHOD

BACKGROUND

1. Technical Field

The present invention relates to a charged particle beam radiation control device and a charged particle beam radiation method.

2. Description of the Related Art

For example, in an accelerator equipped with an internal ion source such as a cyclotron, a radiation state or a non-radiation state of a beam (a charged particle beam) is selected by performing an ON/OFF control of an arc discharge of the ion source. Further, hitherto, a beam blocking device which blocks the beam by moving a shutter disposed around the internal ion source along the beam path in the internal ion source type cyclotron has been known.

SUMMARY

According to an embodiment of the present invention, there is provided a charged particle beam radiation control device that controls radiation of a charged particle beam, the charged particle beam radiation control device including: a controller which controls an acceleration voltage for accelerating charged particle beam, wherein the controller includes a set acceleration voltage controller which selects a non-radiation state of a charged particle beam by setting an acceleration voltage of a radiation state of the charged particle beam to a reference acceleration voltage and changing the acceleration voltage to a set acceleration voltage larger or smaller than the reference acceleration voltage.

According to an embodiment of the present invention, there is provided a charged particle beam radiation method of radiating a charged particle beam to a radiation target, the charged particle beam radiation method including: controlling an acceleration voltage for accelerating the charged particle beam, wherein the controlling includes controlling set acceleration voltage select a non-radiation state of the charged particle beam by setting an acceleration voltage of a radiation state of the charged particle beam to a reference acceleration voltage and changing the acceleration voltage to a set acceleration voltage larger or smaller than the reference acceleration voltage.

DETAILED DESCRIPTION

Figure 8:
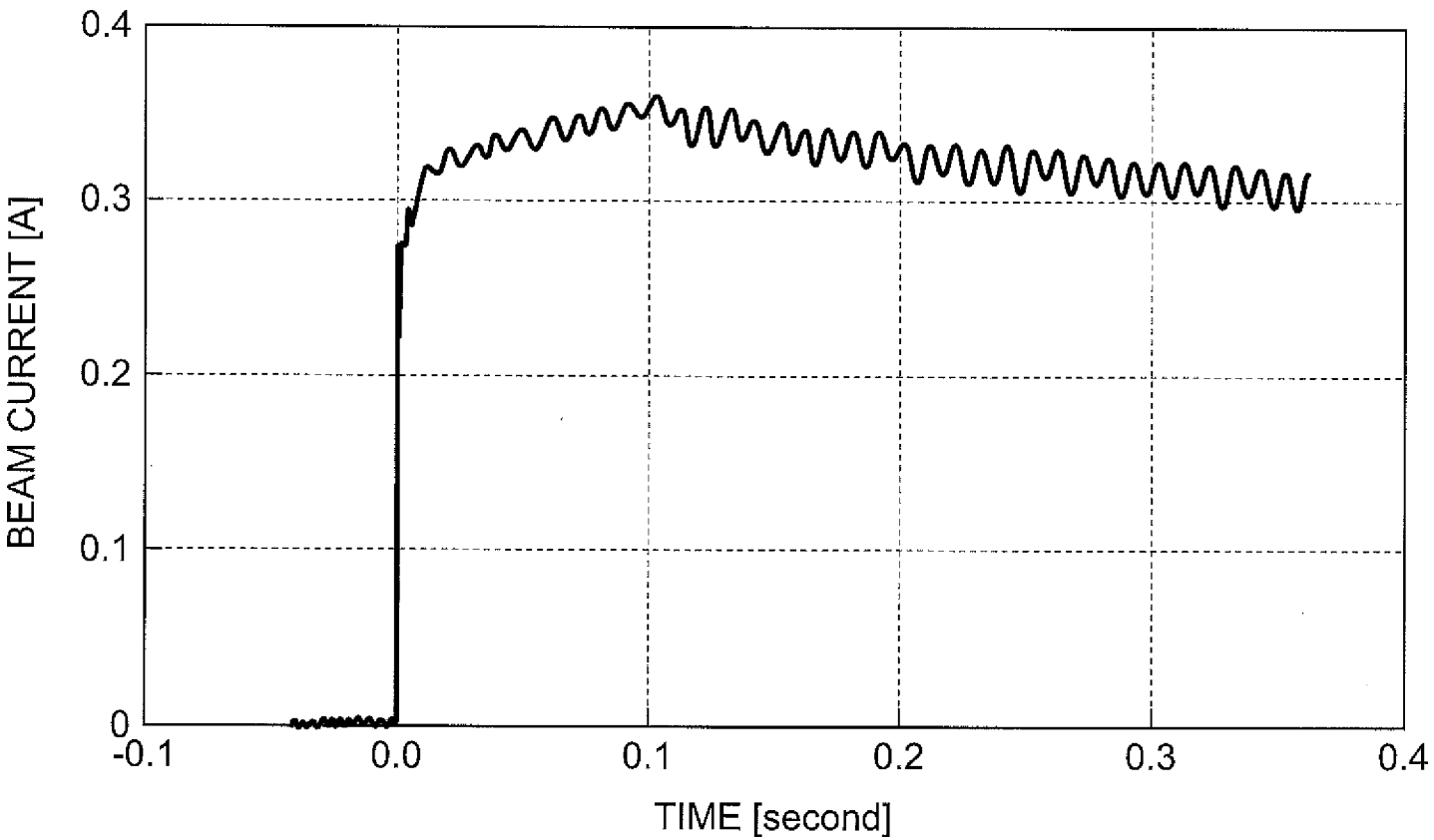
FIG. 8 is a graph illustrating a beam current when the charged particle beam enters the radiation state by performing an ON/OFF control of an arc discharge.

FIG. 8 is a graph illustrating an example of a beam current when an arc discharge is generated by the internal ion source. Since the rising of the arc discharge is not stable as shown in FIG. 8, the beam emitted from the accelerator is also not stable. As a result, there is a concern that an irregular radiation field may be obtained.

Further, the present inventors have recognized that it is difficult to rapidly perform the selection, in the related beam blocking device, since the radiation state or the non-radiation state of the beam is selected mechanically opening or closing the shutter.

It is desirable to provide a charged particle beam radiation control device and a charged particle beam radiation method capable of rapidly selecting the radiation state or the non-radiation state of the charged particle beam and stabilizing the emitted charged particle beam.

In the embodiment of the invention, since the acceleration voltage of the radiation state of the charged particle beam is set to the reference acceleration voltage, and the acceleration voltage is changed to the set acceleration voltage larger or smaller than the reference acceleration voltage, the path of the charged particle beam is changed so that the charged particle beam collides with the object inside the accelerator, thereby selecting the non-radiation state of the charged particle beam. Likewise, since the non-radiation state may be selected just by changing the acceleration voltage to be a large or small value, it is possible to rapidly select the radiation state or the non-radiation state of the charged particle beam. In addition, since it is possible to select the radiation state or the non-radiation state of the charged particle beam without using the ON/OFF control of the arc discharge of the ion source, it is possible to stabilize the charged particle beam without being influenced by the unstable rising of the arc discharge.

Here, the set acceleration voltage controller can control the set acceleration voltage so that the charged particles emitted from the ion source collide with the electrode provided inside the accelerator. Likewise, the non-radiation state is selected in such a manner that the set acceleration voltage is controlled so as to allow the charged particle beam emitted from the ion source to collide with the electrode. Accordingly, the non-radiation state may be selected in such a manner that the charged particle beam collides with the electrode used in the related art.

Further, the arc discharge may be generated from the ion source after the selection of the set acceleration voltage, and the acceleration voltage may be changed to the reference acceleration voltage after the generation of the arc discharge. Accordingly, it is possible to shorten the time for changing the acceleration voltage to the set acceleration voltage. For this reason, it is possible to suppress a decrease in the temperature of the acceleration electrode, and to stabilize the charged particle beam.

Hereinafter, the exemplary embodiment of the invention will be described reference to the accompanying drawings. In the following description, the same reference numerals will be given to the same or corresponding components, and repeated description thereof will be omitted.

Figure 1:
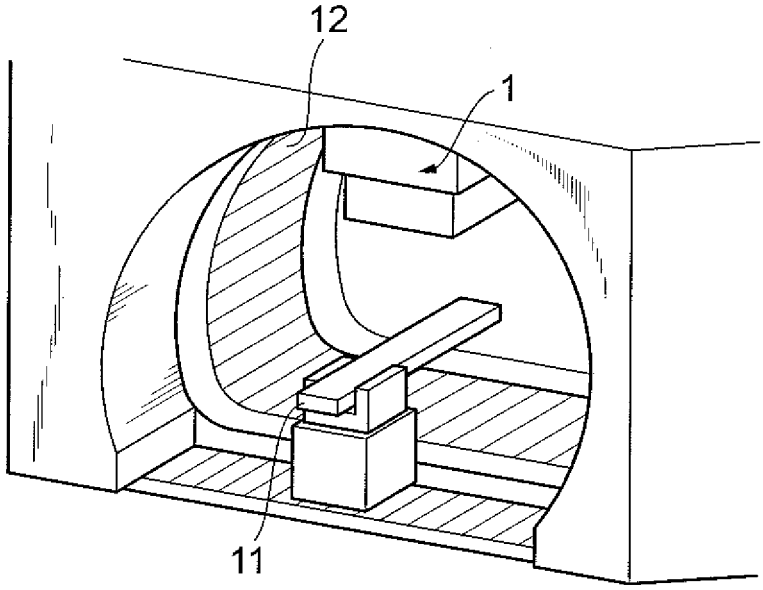
FIG. 1 is a perspective view illustrating a part of a charged particle beam radiation device according to an embodiment of the invention.
Figure 2:
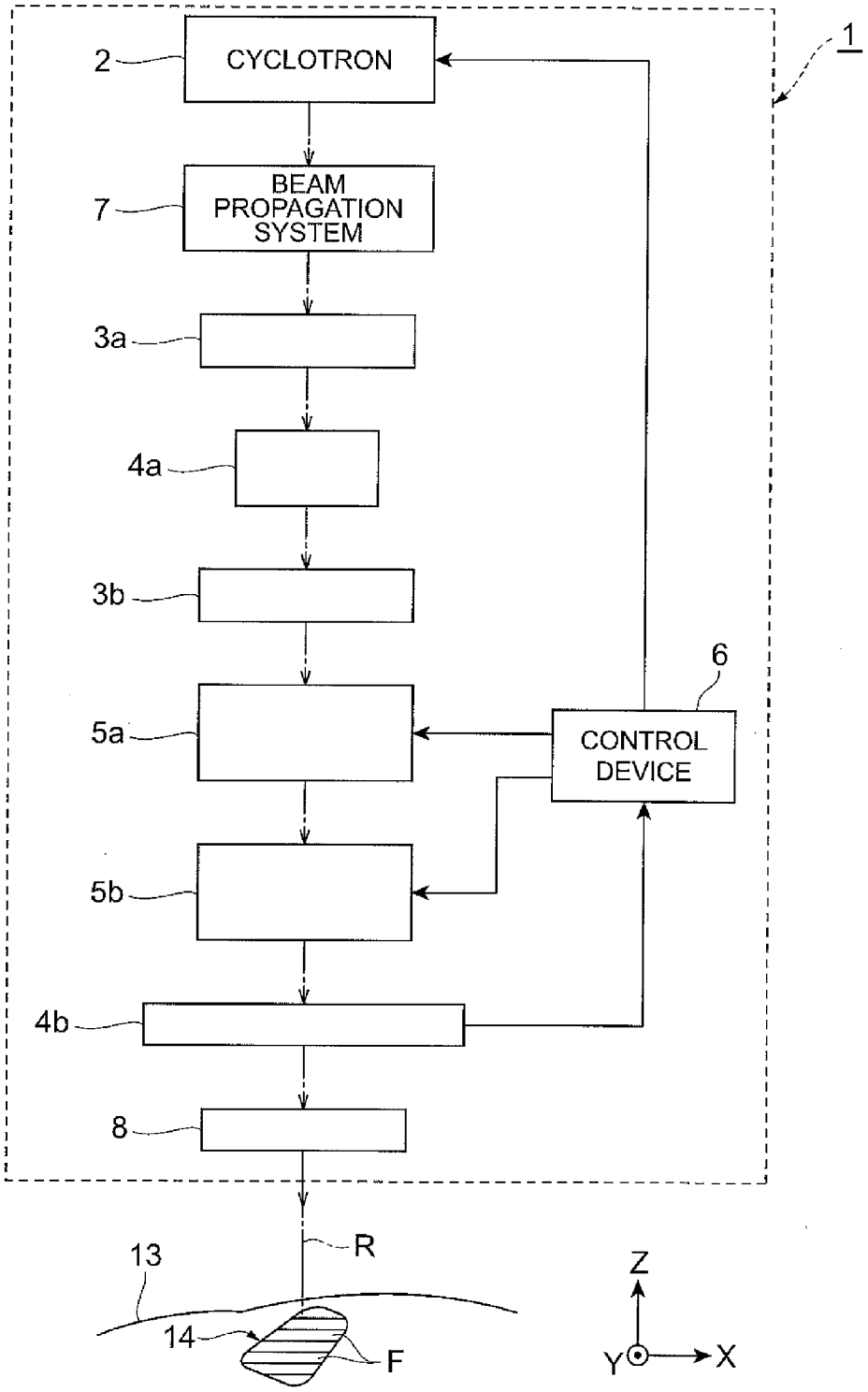
FIG. 2 is a schematic configuration diagram illustrating the charged particle beam radiation device of FIG. 1.

A charged particle beam radiation device according to the embodiment of the invention will be described. FIG. 1 is a perspective view illustrating a part of the charged particle beam radiation device according to the embodiment of the invention, and FIG. 2 is a schematic configuration diagram illustrating the charged particle beam radiation device of FIG. 1. A charged particle beam radiation device 1 shown in FIG. 1 is of a scanning type, and is attached to a rotary gantry 12 so as to surround a therapy table 11 and to be rotatable about the therapy table 11 by the rotary gantry 12. In addition, although it is not shown in FIG. 1, the charged particle beam radiation device 1 includes an accelerator 2 which is distant from the therapy table 11 and the rotary gantry 12.

As shown in FIG. 2, the charged particle beam radiation device 1 continuously radiates a charged particle beam R toward a tumor (a radiation target) 14 inside a body of a patient 13. Specifically, the charged particle beam radiation device 1 divides the tumor 14 into a plurality of layers in the depth direction (Z direction), and continuously radiates (which is called a raster scanning or a line scanning) the charged particle beam R while scanning at a scanning speed V along a radiation line L (refer to FIG. 7) in a radiation field F set for each layer. That is, the charged particle beam radiation device 1 divides the tumor 14 into a plurality of layers and performs plane scanning on each layer in order to form a three-dimensional radiation field in accordance with the tumor 14. Accordingly, the charged particle beam R is radiated in accordance with the three-dimensional shape of the tumor 14.

Figure 7:
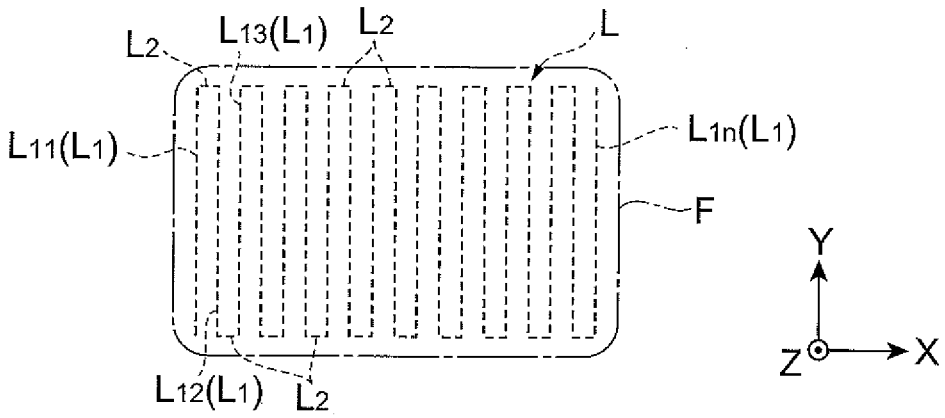
FIG. 7 is a diagram illustrating an operation of the charged particle beam radiation device of FIG. 1.

The charged particle beam R is obtained by rapidly accelerating particles having electrical charges, and an example of the charged particle beam R includes a proton beam, a baryon (heavy ion) beam, an electron beam, or the like. The radiation field F is, for example, a maximum area of 200 mm by 200 mm, and the external shape of the radiation field F exemplified in FIG. 7 is a rectangular shape. In addition, the shape of the radiation field F may be various shapes, and may be, of course, a shape in accordance with the shape of, for example, the tumor 14.

The radiation line L is a planned line (an imaginary line) for radiating the charged particle beam R. In the case of the example of line scanning, the radiation line L herein extends in a rectangular waveform shape, and includes a plurality of first radiation lines L1 (L11 to L1*n*, where n is an integer) arranged in parallel with a predetermined interval and a plurality of second radiation lines L2 connecting one ends or the other ends of the first radiation lines L1 that are adjacent to each other.

Returning to FIG. 2, the charged particle beam radiation device 1 includes: a cyclotron 2; convergence electromagnets 3*a* and 3*b*; monitors 4*a* and 4*b*; scanning electromagnets 5*a* and 5*b*; a fine degrader 8; and a control unit 6.

The cyclotron 2 is a generation source that continuously generates the charged particle beam R. The charged particle beam R generated by the cyclotron 2 is propagated to the convergence electromagnet 3*a* of the rear stage by the beam propagation system 7. The cyclotron 2 is configured to select the radiation state (ON) or the non-radiation state (OFF) of the charged particle beam R on the basis of a command signal output from the control unit 6 thereto.

The convergence electromagnets 3*a* and 3*b* are configured to focus and converge the charged particle beam R. The convergence electromagnets 3*a* and 3*b* are disposed on the downstream side of the cyclotron 2 in the radiation axis of the charged particle beam R (hereinafter, simply referred to as "radiation axis").

The monitor 4*a* is configured to monitor the beam position of the charged particle beam R, and the monitor 4*b* is configured to monitor the beam distribution of the charged particle beam R and the absolute value of the beam amount of the charged particle beam R. The monitor 4*a* is disposed, for example, between the convergence electromagnets 3*a* and 3*b* in the radiation axis, and the monitor 4*b* is disposed, for example, on the downstream side of the convergence electromagnet 3*b* in the radiation axis.

The scanning electromagnets 5*a* and 5*b* are used to scan the charged particle beam R. Specifically, the radiation position of the penetrating charged particle beam R is moved on the radiation field by changing a magnetic field in accordance with the applied current. The scanning electromagnet 5*a* scans the charged particle beam R in the X direction (the direction perpendicular to the radiation axis) of the radiation field F, and the scanning electromagnet 5*b* scans the charged particle beam R in the Y direction (in the direction perpendicular to the X direction and the radiation axis) of the radiation field F. The scanning electromagnets 5*a* and 5*b* are disposed between the convergence electromagnet 3*b* and the monitor 4*b* in the radiation axis. In addition, the scanning electromagnet 5*a* scans the charged particle beam R in the Y direction, and the scanning electromagnet 5*b* scans the charged particle beam R in the X direction.

The fine degrader 8 is configured to radiate the charged particle beam R to each layer of the tumor 14 divided into a plurality of layers in the depth direction. Specifically, the fine degrader 8 adjusts the arrival depth of the charged particle beam R to each layer of the divided layers by changing the energy loss of the penetrating charged particle beam R and adjusting the arrival depth of the charged particle beam R inside the body of the patient 13.

The control device (a controller) 6 is electrically connected to the monitor 4*b* and the scanning electromagnets 5*a* and 5*b*, and controls the operations of the scanning electromagnets 5*a* and 5*b* on the basis of the distribution of the beam amount and the absolute value of the beam amount of the charged particle beam R monitored by the monitor 4*b*. The control device 6 is electrically connected to the cyclotron 2, and controls the operation of the cyclotron 2. The control device 6 controls an acceleration voltage and an arc voltage of the cyclotron 2.

Figure 3:
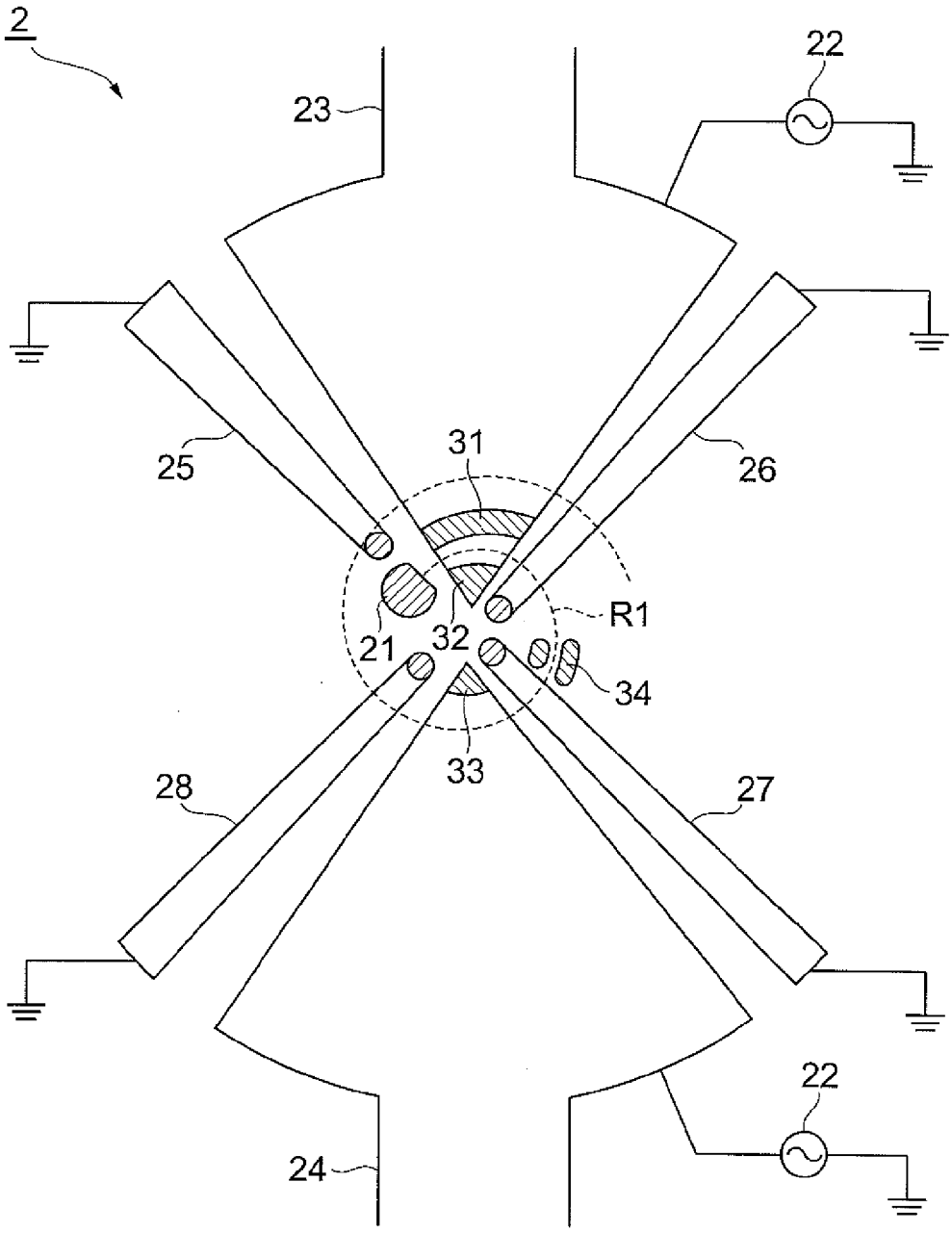
FIG. 3 is a schematic configuration diagram illustrating a cyclotron of FIG. 2.

FIG. 3 is a schematic configuration diagram illustrating the cyclotron of FIG. 2. The cyclotron 2 includes an ion source (a charged particle generating source) 21 which generates ionized particles (charged particles); a pair of acceleration electrodes 23 and 24 which is connected to a high-frequency power supply 22 and accelerates the charged particles; a plurality of counter electrodes 25 to 28 which is disposed on both sides of the acceleration electrodes 23 and 24; and a phase slit 34 which is disposed on both sides of a circulation path R1 of the charged particles.

The acceleration electrode 23 includes center electrodes 31 and 32 which are disposed at the center of the cyclotron 2 and define the circulation path R1 of the charged particles. The acceleration electrode 24 includes a center electrode 33 which is disposed at the center of the cyclotron 2 and defines the circulation path R1 of the charged particles.

The acceleration voltage is applied from the acceleration electrodes 23 and 24 to the charged particles generated by the ion source 21, and the charged particles are accelerated while circulating on the circulation path R1 in the normal radiation state.

The control device 6 serves as a controller for controlling the acceleration voltage for accelerating the charged particles. The control device 6 controls the radiation state/the non-radiation state of the charged particle beam R by changing the acceleration voltage.

The control device 6 sets the charged particle beam R to be in the non-radiation state in such a manner that the acceleration voltage of the radiation state is set to a reference acceleration voltage V(H) and the acceleration voltage is changed to a set acceleration voltage V(L) smaller than the reference acceleration voltage V(H). It is desirable that the set acceleration voltage V(L) is lower than the reference acceleration voltage V(H) by roughly 10 to 30%. The lower limit of the set acceleration voltage V(L) is restricted by the multi-factoring condition of the acceleration cavity.

In addition, the control device 6 serves as an arc voltage controller for controlling an arc voltage for causing arc discharge of the ion source 21.

Figure 5:
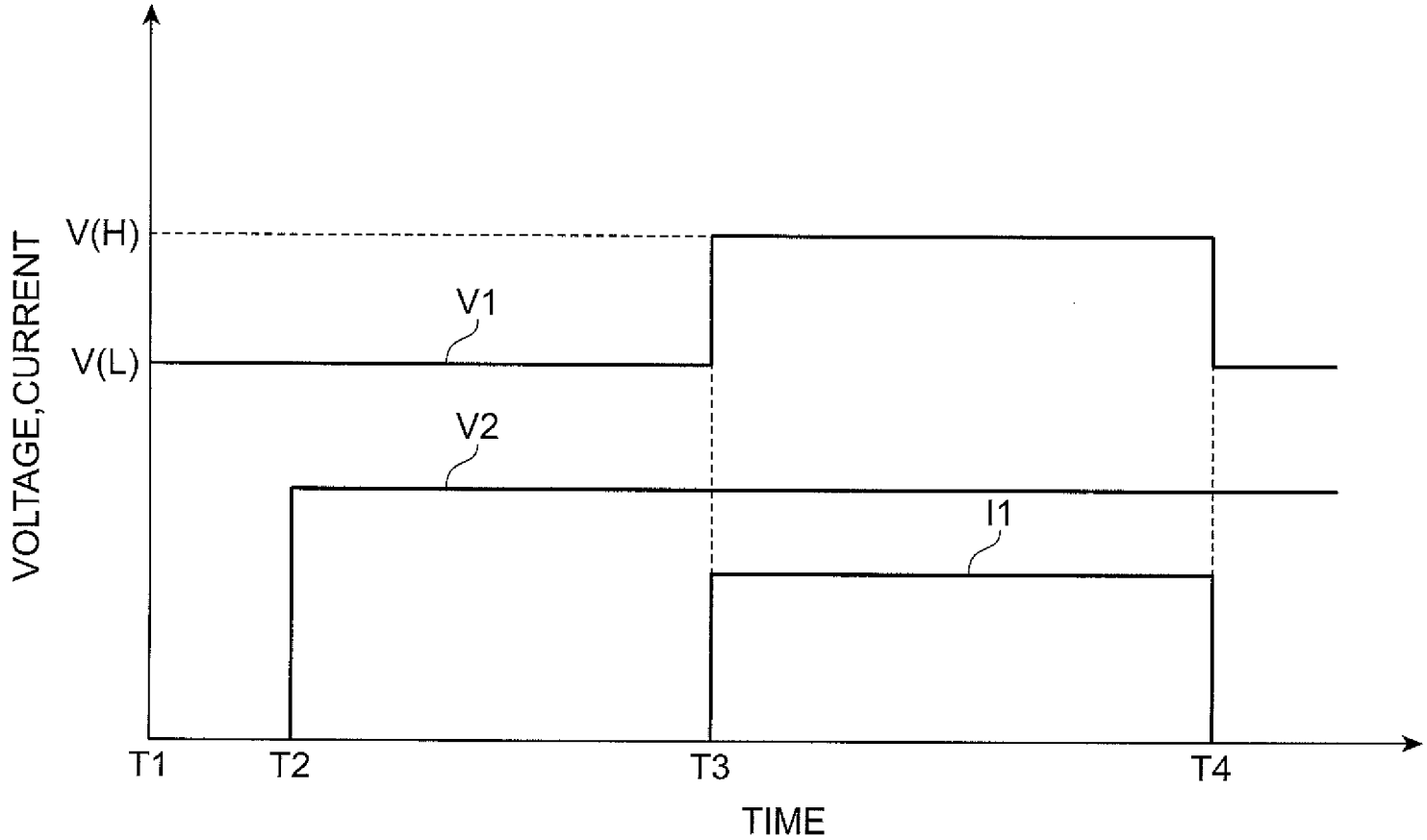
FIG. 5 is a graph illustrating a relationship between an acceleration voltage, an arc voltage, and a beam current when only the acceleration voltage is changed.

FIG. 5 is a graph illustrating a relationship between an acceleration voltage, an arc voltage, and a beam current when only the acceleration voltage is changed. In FIG. 5, the horizontal axis indicates the elapse of time, "V1" indicates the acceleration voltage, "V2" indicates the arc voltage, and "I1" indicates a variation in the beam current.

First, the control device 6 sets the acceleration voltage V1 to the set acceleration voltage V(L) at time T1. Subsequently, the control device 6 generates an arc voltage V2 in the ion source 21 at time T2. At this time, the charged particles emitted from the ion source 21 move along the path R0 depicted by the solid line of FIG. 4, and collide with the center electrode 32. The charged particles vanish, thereby entering the non-radiation state.

Subsequently, the control device 6 sets the acceleration voltage V1 to the reference acceleration voltage V(H) at time T3. At this time, the charged particles emitted from the ion source 21 are accelerated while moving along the path R1 depicted by the dashed line of FIG. 4, thereby entering the radiation state.

Subsequently, the control device 6 sets the acceleration voltage V1 to the set acceleration voltage V(L) at time T4. At this time, the charged particles emitted from the ion source 21 move along the path R0 depicted by the solid line of FIG. 4, and collide with the center electrode 32. The charged particles vanish, thereby entering the non-radiation state.

Figure 6:
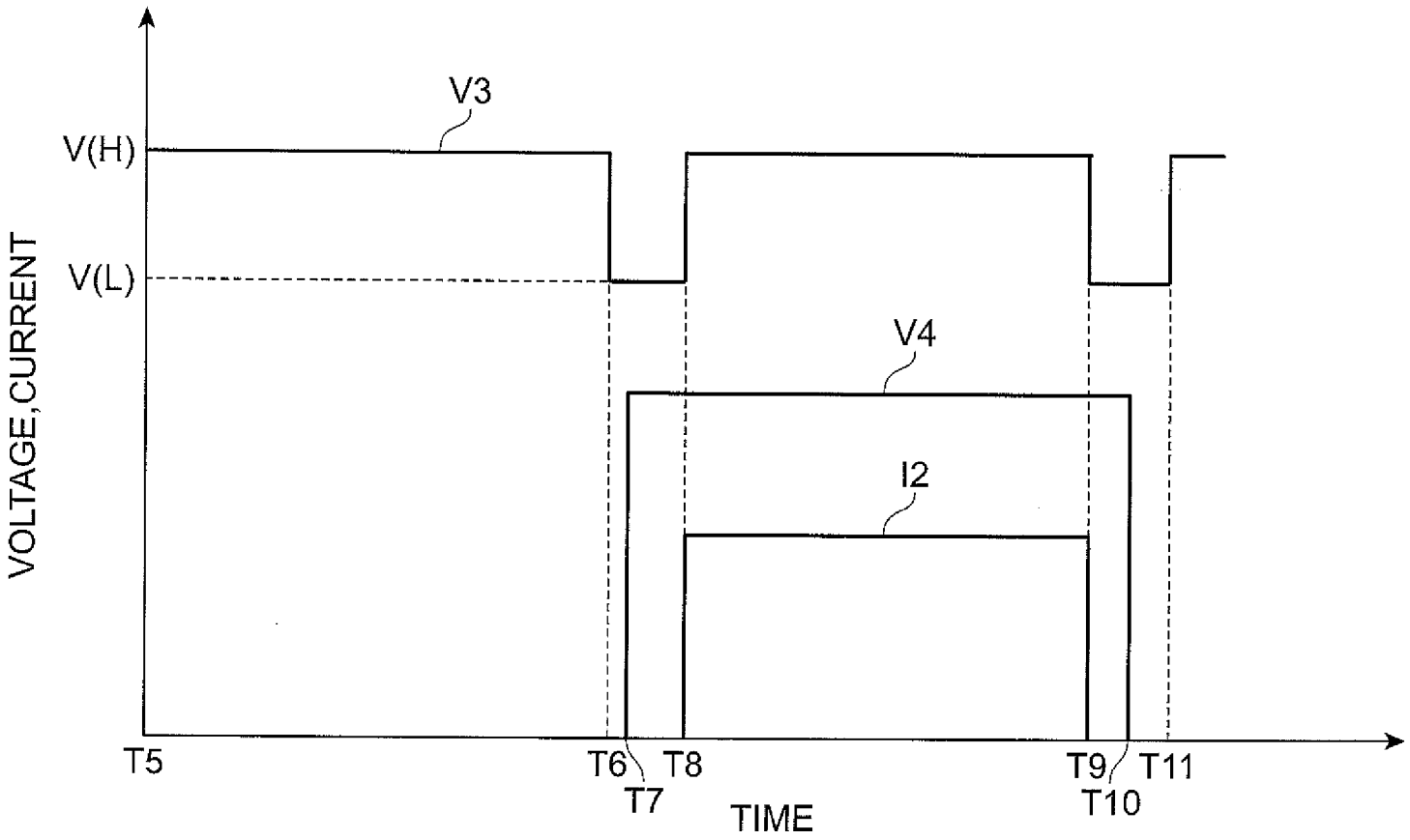
FIG. 6 is a graph illustrating a relationship between an acceleration voltage, an arc voltage, and a beam current when an ON/OFF control of the arc voltage is performed.

FIG. 6 is a graph illustrating a relationship between an acceleration voltage, an arc voltage, and a beam current when the ON/OFF control of the arc voltage is performed. In FIG. 6, the horizontal axis indicates the elapsing of time, "V3" indicates the acceleration voltage, "V4" indicates the arc voltage, and "I2" indicates a variation in the beam current.

First, the control device 6 sets the acceleration voltage V3 to the reference acceleration voltage V(H) at time T5. Subsequently, the control device 6 sets the acceleration voltage V3 to the set acceleration voltage V(L) at time T6. Subsequently, the control device 6 sets the non-radiation state by generating the arc voltage V4 at time T7, and sets the acceleration voltage V3 to the reference acceleration voltage V(H) at time T8. At this time, the charged particles emitted from the ion source 21 are accelerated while moving along the path R1 depicted by the dashed line of FIG. 4, thereby entering the radiation state.

Subsequently, the control device 6 sets the acceleration voltage V3 to the set acceleration voltage V(L) at time T9. At this time, the charged particles emitted from the ion source 21 move along the path R0 depicted by the solid line of FIG. 4, and collide with the center electrode 32. The charged particles vanish, thereby entering the non-radiation state.

Subsequently, the control device 6 turns off the arc voltage V4 at time T10, and sets the acceleration voltage V3 to the reference acceleration voltage V(H) at time T11.

Subsequently, the operation of the charged particle beam radiation device 1 will be described.

The charged particle beam radiation device 1 divides the tumor 14 into a plurality of layers in the depth direction, and radiates the charged particle beam R toward the radiation field F set for each layer. Then, the charged particle beam R is radiated in accordance with the three-dimensional shape of the tumor 14 by repeatedly performing the radiation operation for each layer.

The charged particle beam R is radiated in parallel along the radiation line L of the radiation field F by controlling the scanning electromagnets 5*a* and 5*b* using the control device 6 when radiating the charged particle beam R.

Here, when the charged particle beam R is in the radiation state, the control device 6 generates arc discharge from the ion source 21, and accelerates the charged particles by controlling the acceleration voltage using the reference acceleration voltage V(H) (a control procedure). Accordingly, the accelerated charged particles are radiated from the cyclotron 2.

Figure 4:
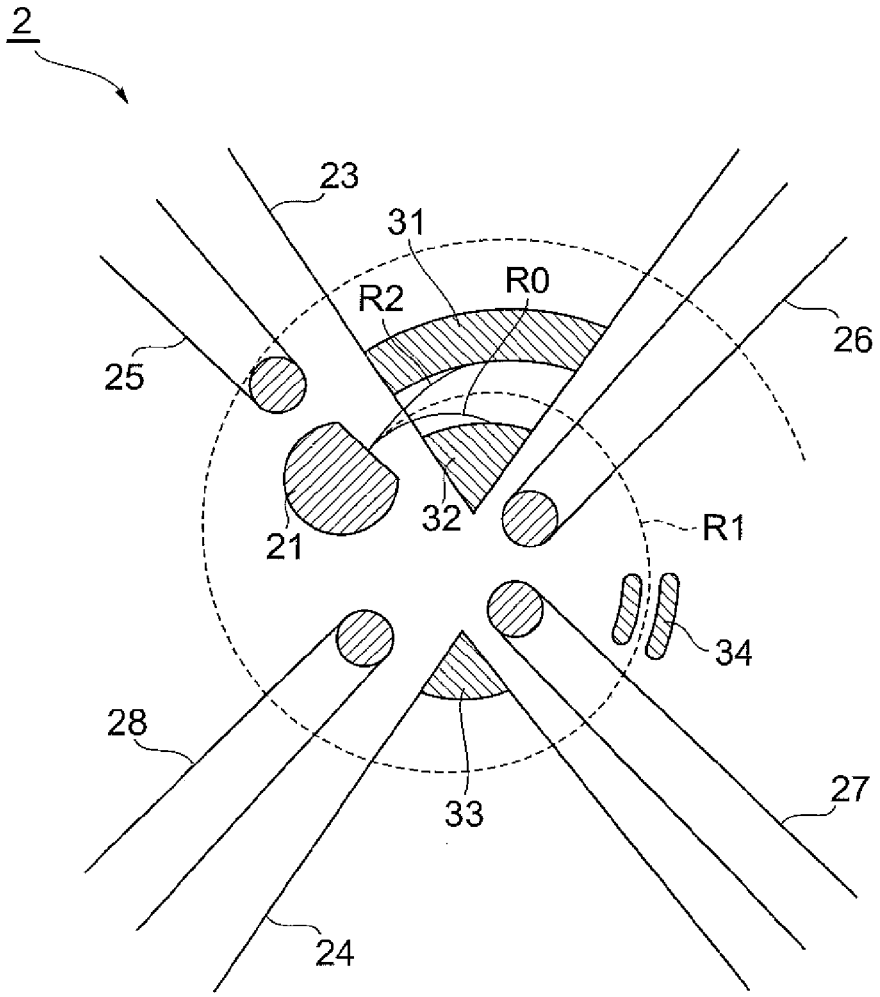
FIG. 4 is an enlarged view illustrating a main part of the vicinity of the center of the cyclotron of FIG. 3.

On the other hand, when the charged particle beam R is changed from the radiation state to the non-radiation state, the control device 6 changes the acceleration voltage from the reference acceleration voltage V(H) to the set acceleration voltage V(L) (a set acceleration voltage control procedure). Accordingly, the charged particles emitted from the ion source 21 advance along the path R0 as shown in FIG. 4, and collide with the center electrode 32, thereby stopping the acceleration thereof. For this reason, the charged particles are not radiated the cyclotron 2.

When the charged particle beam R is changed the non-radiation state to the radiation state, the control device 6 changes the acceleration voltage from the set acceleration voltage V(L) to the reference acceleration voltage V(H).

Likewise, according to the charged particle beam radiation device 1 of the embodiment, since the acceleration voltage of the radiation state of the charged particle beam is set to the reference acceleration voltage, and the acceleration voltage is changed to the set acceleration voltage smaller than the reference acceleration voltage, the charged particle beam enters the non-radiation state. That is, the path of the charged particle beam is changed by decreasing the acceleration voltage, and the charged particle beam vanish while colliding with the center electrode 32. Likewise, since the charged particle beam is able to enter the non-radiation state just by changing the acceleration voltage to a small voltage, it is possible to rapidly select the radiation state or the non-radiation state of the charged particle beam. In addition, the charged particle beam radiation device 1 of the embodiment is capable of performing the ON/OFF control of the beam current at, for example, 1 ms or less.

Since the charged particle beam radiation device equipped with the charged particle beam radiation control device of the invention is capable of rapidly performing the selection of the radiation state/the non-radiation state (the ON/OFF control) of the charged particle beam, the charged particle beam radiation device may be effectively used in the therapy apparatus for performing scanning radiation. When the scanning radiation is performed, it is important to stabilize the beam at, for example, 1 ms or less, and it is possible to appropriately maintain uniformity of the beam by changing and stabilizing the beam at 1 ms or less. For example, in the radiation along the first radiation line L1 of FIG. 7, the continuous radiation of 10 ms or less is performed for each line.

In addition, since the radiation state or the non-radiation state of the charged particles may be selected without using the ON/OFF control of the arc discharge of the ion source 21, the selection is not influenced by the unstable rising of the arc discharge. Accordingly, it is possible to stabilize the charged particle beam after the charged particle beam enters the radiation state.

Further, since a configuration is adopted in which the charged particle beam vanishes while colliding with the center electrode 32, it is possible to select the non-radiation state of the charged particle beam by using the center electrode 32 used in the related art.

Furthermore since the non-radiation state may be selected without turning off the acceleration voltage, the temperature of the acceleration electrode does not greatly decrease.

Here, when a decrease in the temperature of the acceleration electrode is further suppressed, the ion source arc is turned off and the acceleration voltage is set to the reference acceleration voltage V(H) immediately before the charged particle beam enters the radiation state. Subsequently, the acceleration voltage is changed from the reference acceleration voltage V(H) to the set acceleration voltage V(L), and an arc discharge is generated from the ion source 21. Subsequently, after the arc discharge, the acceleration voltage is changed from the set acceleration voltage V(L) to the reference acceleration voltage V(H). Accordingly, since the time for controlling the acceleration voltage to be the set acceleration voltage V(L) is shortened, it is possible to minimally suppress a decrease in the temperature of the acceleration electrode, and to stabilize the charged particle beam.

Figure 9:
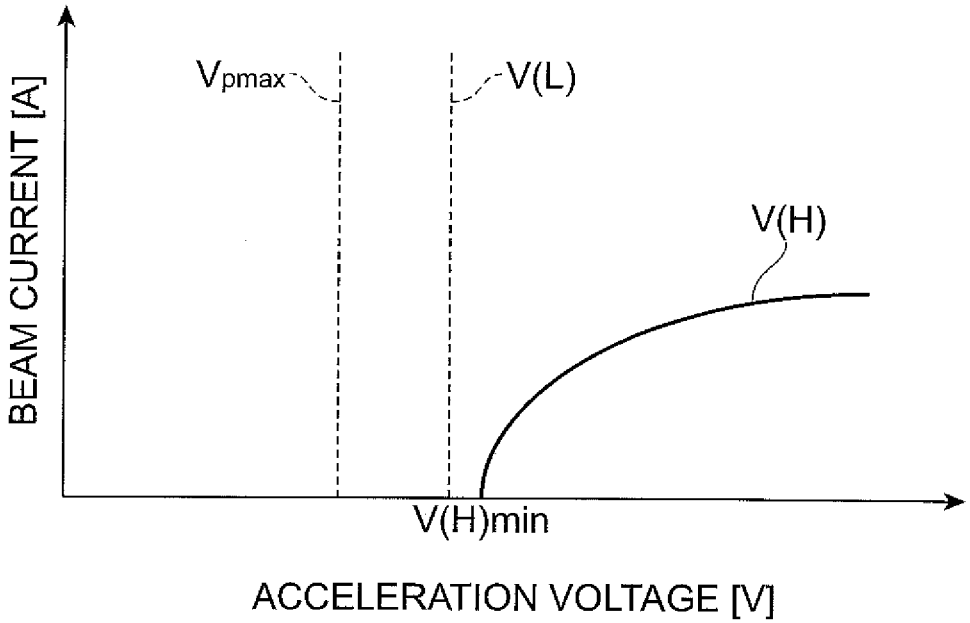
FIG. 9 is a graph illustrating a relationship between an acceleration voltage and a beam current.

FIG. 9 is a graph illustrating a relationship between an acceleration voltage and a beam current. In FIG. 9, the horizontal axis indicates the acceleration voltage, and the vertical axis indicates the beam current. In the drawing, "$V_{pmax}$" indicates the maximum voltage of the multi-factoring condition of the acceleration cavity, "V(L)" indicates the set acceleration voltage V(L), and "V(H)" indicates the reference acceleration voltage V(H). In addition, "$V(H)_{min}$" indicates the acceleration voltage $V(H)_{min}$ starting to generate the beam current. The acceleration voltage $V(H)_{min}$ starting to generate the beam current is different for each cyclotron, and does not have simple regularity. The set acceleration voltage V(L) may be set to be lower than the acceleration voltage $V(H)_{min}$. Further, as shown in FIG. 9, the reference acceleration voltage V(H) has predetermined range, and is not the value for one point.

While the embodiment of the invention has been described in detail, the invention is not limited thereto. In the above-described embodiment, the non-radiation state of the charged particle beam is selected in such a manner that the acceleration voltage of the radiation state of the charged particle beam is set to the reference acceleration voltage, and the acceleration voltage is changed to the set acceleration voltage smaller than the reference acceleration voltage. However, the non-radiation state of the charged particle beam may be selected by changing the acceleration voltage to the set acceleration voltage larger than the reference acceleration voltage.

FIG. 4 shows the path R2 of the charged particles when the acceleration voltage is changed to the set acceleration voltage larger than the reference acceleration voltage. The path R2 of this case is located closer to the outside in the radial direction than the circulation path R1 of the normal radiation state, and the charged particles collide with the center electrode 31. Accordingly, the charged particle beam is capable of entering the non-radiation state.

Further, in the above-described embodiment, the set acceleration voltage is determined so that the charged particles emitted from the ion source collide with the center electrode 32. However, for example, the non-radiation state may be selected in such a manner that the charged particles collide with other center electrodes, an acceleration electrode, a counter electrode, a phase slit, a wall body, or the like.

Furthermore, in the above-described embodiment, the charged particle beam radiation device (method) of the invention is applied to the medical field. However, for example, the charged particle beam radiation device may be applied to an industrial radiation irradiation device for semiconductor wafer 1C irradiation of other fields.

It should be understood that the invention is not limited to the above-described embodiment, but may be modified into various forms on the basis of the spirit of the invention. Additionally, the modifications are included in the scope of the invention.

What is claimed is:

1. A charged particle beam radiation device that radiates a charged particle beam, the charged particle beam radiation device comprising:

an ion source configured to generate charged particles, an accelerator configured to accelerate the charged particles by applying an acceleration voltage to the charged particles generated by the ion source from an acceleration electrode, and a controller configured to control the acceleration voltage, wherein the controller includes a set acceleration voltage controller configured to select a non-radiation state of the charged particle beam by setting the acceleration voltage of the charged particle beam to a reference acceleration voltage and changing the acceleration voltage to a set acceleration voltage larger or smaller than the reference acceleration voltage, the charged particles emitted from the ion source collide with a center electrode provided inside the accelerator during the non-radiation state, and the non-radiation state of the charged particle beam is selected without using an ON-or-OFF control of an arc discharge of the ion source.

2. The charged particle beam radiation device according to claim 1, further comprising:

an arc voltage controller configured to generate the arc discharge of the ion source after the selection of the set acceleration voltage, wherein the controller changes the acceleration voltage to the reference acceleration voltage after the generation of the arc discharge.

3. A charged particle beam radiation method of radiating a charged particle beam to a radiation target, the charged particle beam radiation method comprising:

generating charged particles by an ion source; and controlling an acceleration voltage for applying to the charged particles from an acceleration electrode of an accelerator and accelerating the charged particle beam, wherein the controlling includes controlling set acceleration voltage to select a non-radiation state of the charged particle beam by setting the acceleration voltage of the charged particle beam to a reference acceleration voltage and changing the acceleration voltage to a set acceleration voltage larger or smaller than the reference acceleration voltage, the charged particles emitted from the ion source collide with a center electrode provided inside the accelerator during the non-radiation state, and the non-radiation state of the charged particle beam is selected without using an ON-or-OFF control of an arc discharge of the ion source.

4. The charged particle beam radiation method according to claim 3, further comprising:

controlling an arc voltage to generate the arc discharge of the ion source after the selection of the set acceleration voltage, wherein in the controlling, the acceleration voltage is changed to the reference acceleration voltage after the generation of the arc discharge.

* * * * *